United States Patent [19]

Leroy et al.

[11] Patent Number: 4,498,426

[45] Date of Patent: Feb. 12, 1985

[54] SUPERHEATED STEAM GENERATOR COMPRISING BANK OF U-TUBES

[75] Inventors: Jean-Luc Leroy, Gif-sur-Yvette; Pol Dejeux, Nogent-sur-Marne, both of France

[73] Assignee: Framatome & Cie, Courbevoie, France

[21] Appl. No.: 461,065

[22] Filed: Jan. 26, 1983

[30] Foreign Application Priority Data

Feb. 4, 1982 [FR] France ..... 82 01784

[51] Int. Cl.[3] ..... F22B 1/06

[52] U.S. Cl. ..... 122/32; 122/34; 122/235 R

[58] Field of Search ..... 122/235 E, 31 R, 32-34, 122/DIG. 4; 165/159-161

[56] References Cited

U.S. PATENT DOCUMENTS 3,807,365 4/1974 Lyman ..... 122/32

3,854,453 12/1974 Mayer ..... 122/32

3,896,770 7/1975 Byerley ..... 122/34 X

*Primary Examiner*—Henry C. Yuen

*Attorney, Agent, or Firm*—Pollock, Vande Sande & Priddy

[57] ABSTRACT

The invention relates to a superheated steam generator comprising a bank of U-tubes.

It comprises a water drum (1) and a secondary casing (14) which are welded one on each side of the tube plate (5) and a bank of tubes (6) fixed on the tube plate (5) and contained in a casing (12) disposed inside the secondary casing (14) and forming an annular space (15) lying between the casings (12 and 14). Above the tube bank casing (12) a free space (25) is provided inside the secondary casing (14). This free space (25) constitutes a reserve of feed water in communication with the annular space (18). The water capacity thus constituted can be fed by at least one supply means (26).

The invention is particularly applicable to pressurized-water nuclear reactors.

3 Claims, 5 Drawing Figures

SUPERHEATED STEAM GENERATOR COMPRISING BANK OF U-TUBES

BACKGROUND OF THE INVENTION

The invention relates to a superheated steam generator comprising a bank of U-tubes.

Steam generators of this kind are for example used in the case of pressurized-water nuclear reactors and serve to produce steam by using the pressurized water of the reactor as primary fluid for heating and vaporizing the feed water.

These steam generators comprise a water drum, consisting of two portions separated by a partition, for supplying the tubes of the bank with hot primary fluid and for discharging the cooled primary fluid after it has passed through the tube bank and has come into thermal contact with the feed water which is to be vaporized. The U-tubes of the bank are fixed on a tube plate, of which one face, the inlet face, is situated on the water drum side. The ends of the tubes are flush with this inlet face, and each of the tubes is thus in communication with both the feed portion and the evacuation portion of the water drum.

The bank of tubes disposed vertically inside the upper part of the steam generator, the outer casing of which is known as the "secondary casing", passes through the other face of the tube plate, i.e., its outlet face.

The water drum and the secondary casing are welded on the tube plate, one on each side of the latter, i.e., at its inlet and outlet faces respectively.

The bank of U-tubes is itself disposed inside a casing coaxial to the secondary casing and located inside the latter, in such a manner that an annular space is left between the outer wall of the tube bank casing and the inner wall of the secondary casing.

PRIOR ART

In superheated steam generators, the feed water is supplied through a pipe connection at the base of the tube bank, on the cold branch side of the latter, i.e., on the side through which the primary fluid passes out. This feed water can for example be introduced through the pipe connection into the annular space between the secondary casing and the tube bank casing, and then introduced into the interior of the tube bank casing, on the cold branch side, through an opening provided in the tube bank casing above the tube plate.

In superheated steam generators of this kind, the cold branch and the hot branch of the tube bank are separated by a partition joined to the tube plate and enabling the circulation of feed water and then of steam to be guided along the bank of tubes.

The feed water coming into contact with the cold branch of the tube bank starts to be heated and to rise along this cold branch until the moment when vaporization starts, the circulation of the two-phase water-steam mixture and then the circulation of the steam continuing as a downward movement along the hot branch of the tube bank after passing around the top of the partition. The circulation of the steam along the hot branch makes it possible to obtain dry steam and then superheated steam, which is recuperated at the bottom of the hot branch of the tube bank by a steam recuperator leading into a pipe connection passing through the secondary casing.

The principal advantage of these superheated generators is that it is not necessary to provide a water-steam separator in the path of the steam before it passes out of the generator, in order to dry the steam.

Nevertheless, in conventional steam generators which are used in pressurized-water nuclear power stations and in which the steam is not superheated, the top part of the secondary casing containing the steam-water separators makes it possible to recover a part of the feed water entrained with the steam, thus constituting a reserve of recirculation water above the tube bank casing. This reserve of water makes it possible to feed the steam generator for a sufficient length of time to enable the nuclear power station operators to intervene should there be an accidental complete failure of the feed water supply to the steam generator.

A safety reserve of this kind does not exist in the case of superheated steam generators.

Moreover, in some of these superheated steam generators, the emergency feed water, in the case of faulty operation of the normal supply circuit, is supplied to the steam generator in the proximity of the tube plate, thus giving rise to the thermal shock in the case of use of this emergency circuit, in which the water is at a much lower temperature than that of the primary fluid.

SUMMARY OF THE INVENTION

The object of the invention is therefore a superheated steam generator comprising a bank of U-tubes and a two-part water drum for supplying the tubes with hot primary fluid and for discharging the cooled primary fluid after it has passed through the tube bank and come into thermal contact with the feed water which is to be vaporized, and further comprising a secondary casing enclosing the feed water, a tube plate in which the tubes of the tube bank are fixed and which is fastened to the water drum at its inlet face, with which the ends of the tubes are flush, and to the secondary casing at its outlet face through which the bank of tubes passes, and a casing enclosing the bank of tubes and disposed inside the secondary casing in such a manner as to form, in conjunction with the secondary casing, an annular space into which a feed water inlet connection leads on the bank outlet branch side, i.e., the cold branch side, the tube bank casing having at least one opening above the tube plate for the passage of the feed water into the interior of the tube bank casing in order to bring the said feed water into contact with the cold branch, while a separating partition joined to the tube plate is disposed between the cold branch and the hot branch of the tube bank through which the primary fluid arrives, thus enabling the feed water and then the steam to be guided along the tube bank, and a superheated steam recuperator is disposed in the proximity of the end of the hot branch which passes through the tube plate, for the purpose of evacuating the superheated steam through a pipe connection leading into the annular space, this steam generator having to continue to operate, after an interruption of the water supply, for a sufficient time to effect the extraction of heat and to make it possible to avoid a deterioration of the core of the reactor before an emergency supply intervenes, while avoiding a thermal shock on the tube plate.

To this end a free space is provided, above the tube bank casing inside the secondary casing, in order to form a reserve of feed water in communication with the annular space and with at least one means of supplying water at a temperature lower than the temperature of the primary fluid.

BRIEF DESCRIPTION OF THE DRAWINGS

In order to enable the invention to be well understood, a description will now be given, by way of example and with reference to the accompanying drawings, of several embodiments of a superheated steam generator comprising a bank of U-tubes according to the invention.

DETAILED DESCRIPTION

Figure 1:
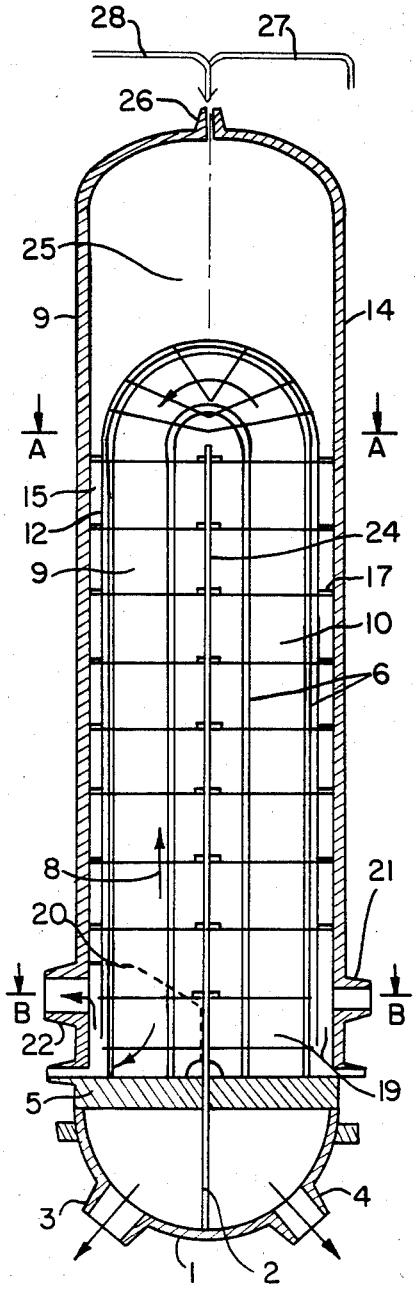
FIG. 1 is a view in section through a vertical plane of symmetry of a steam generator according to the invention, which is utilizable in a pressurized-water nuclear power station.

FIG. 1 shows a steam generator comprising a water drum 1 fed with pressurized water through a pipe connection 3 on one side of the partition 2, the pressurized water being evacuated through a pipe connection 4 in the second part of the water drum situated on the other side of the partition 2.

The water drum 1 is fixed on a tube plate 5 through which pass the ends of the tubes 6 of the bank, which are fixed inside holes in this tube plate.

The ends of the tubes are flush with the bottom or inlet face of the plate 5, so that one end of each tube is in communication with one of the parts of the water drum and the other end is in communication with the other part of the water drum. In this way, the circulation of the water in the bank of tubes takes place in the direction of the arrow 8, i.e., first passing from bottom to top inside the hot branch 9, whereupon this primary water passes from top to bottom inside the cold branch 10.

Around the tube bank 6 is disposed a cylindrical tube bank casing 12 closed by a spherical end at the top. The tube bank casing 12 is in turn disposed inside a secondary casing 14 fixed on the tube plate and forming an annular space 15 around the tube bank casing 12.

Figure 2:
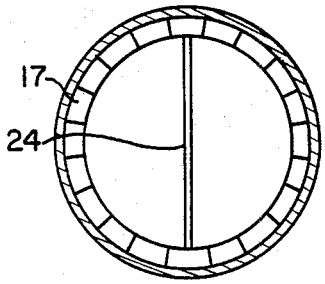
FIG. 2 is a view in section on the line A—A in FIG. 1.

As can be seen in FIGS. 1 and 2, horizontal and vertical spacers 17 enable the tube bank casing to be centered and supported inside the secondary casing.

At the bottom the tube bank casing does not rest directly on the tube plate, so that on the cold branch (10) side a passage 19 is formed between the bottom of the tube bank casing and the tube plate.

On the hot branch side 9 the tube bank casing 12 is connected to the steam recuperator 20, which will be described in greater detail with reference to FIG. 4 or FIG. 5.

The secondary casing is provided with a pipe connection 21 for supplying feed water to the annular space 15, this feed water then falling to the bottom of the annular space and then being introduced into the interior of the tube bank casing through the passage 19. The secondary casing is also provided with a pipe connection 22 for the discharge of the steam, this pipe connection 22 being in communication with the outlet of the steam recuperator 20.

The inside volume of the tube bank casing is divided into two parts up to the top end of the straight portion of the tubes by a median partition 24, which enables the circulation of the feed water and steam to be guided inside the casing 12.

Figure 3:
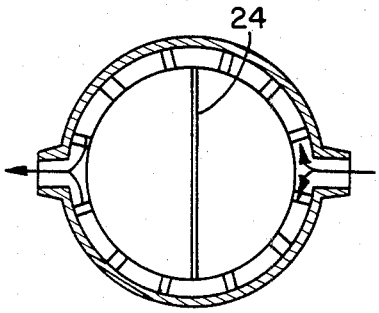
FIG. 3 is a view in section on the line B—B in FIG. 1.

As can be seen in FIGS. 1 and 3, the feed water introduced into the annular space 15 through the pipe connection 21 is divided into two descending currents in this annular space and enters the tube bank casing through the bottom passage 19 above the tube plate. The feed water is thus perfectly distributed at the bottom of the cold branch of the bank of tubes, in contact with which this feed water is heated.

The feed water heated inside the cold branch part of the bank of tubes is guided by the tube bank casing and the median partition 24.

As it circulates in contact with the branch 10 of the tube bank, the feed water heats up and then starts to vaporize, and the two-phase water-steam mixture continues to circulate along the bank of tubes.

Vaporization is complete after the two-phase mixture has travelled a certain distance along the top part of the hot branch, from the top downwards, so that the superheating of the steam takes place during the last part of the travel of the steam along the hot branch of the bank of tubes, before reaching the steam recuperator 20.

As can be seen in FIG. 3, recuperation of steam is effected in the lower part of the tube bank casing 12 through the passage of the steam inside the casing of the recuperator.

The casing 14 has been extended over a relatively considerable height above the tube bank casing 12, so as to form a free space 25 in communication with the annular space 15 and with a pipe connection 26 connected to a pipe 27 branched off from the main feed water pipe and to a pipe 28 receiving emergency feed water from the safety system of the steam generator.

In the case of a steam generator of a pressurized-water nuclear reactor of the type at present built, with a thermal power of the order of 1000 MW, it is desirable to have a reserve of feed water in the space 25 of the order of 50 tons in order to permit temporary automatic emergency feeding of the steam generator, in the event of feed water failure, for a sufficient period of time to allow the operators to intervene.

The section of these steam generators is such that it is possible to store 10 tons of water per linear meter of the secondary casing, above the tube bank casing.

In order to have available a reserve of water permitting intervention after an accident in the feed water system under very good conditions, it is therefore necessary to raise the secondary casing above the tube bank casing by a height of the order of 5 meters.

However, it has also been determined that for a steam generator of a power of 1000 MW, it is possible, without inacceptably reducing the operating safety of the steam generator, to reduce the reserve of water to 20 tons. In this case, still for the same type of steam generator, it is possible to increase the height of the secondary casing by only two meters.

The thermal power of the steam generator is determined from the flow of primary fluid and the inlet and outlet temperatures of that fluid. In the case of nuclear reactors, these parameters are perfectly defined, so that it is possible to determine the emergency water capacity required to permit intervention in the event of the interruption of the water supply to the steam generator, and therefore to determine the necessary dimensions of the space 25 inside the secondary casing, above the tube bank casing.

During the normal running of the steam generator, a part of the feed water filling the secondary casing 14 comes into contact with the tube bank casing 12, in the annular space 15 in the proximity of the hot branch 9. A part of this feed water is therefore vaporized and the steam accumulates in the highest part of the casing 14. The introduction of water at the inlet temperature through the pipe connection 26 makes it possible to condense this steam and to keep the emergency water space 25 completely full durng the normal operation of the steam generator.

Moreover, in the event of the utilization of the emergency supply, the feed water in the pipe 28 passes into the top part of the casing 14 through the pipe connection 26, is mixed with the water in the space 25, and is heated before falling into the annular space 15.

The disadvantage of having a cold shock at the level of the tube plate, which occurred when use was made of emergency feeding in the proximity of this tube plate, is thus eliminated.

The embodiment illustrated in FIGS. 1, 2 and 3 illustrates the use of a median partition 24 dividing the bank of tubes into two perfectly symmetrical parts, which was not the case with superheated generators of the prior art.

In these steam generators of the prior art, in fact, the vaporization was effected in the rising part of the circulation of feed water along the bank of tubes, while superheating of the steam was effected in the falling part.

This made it necessary to reduce the amount of heat supplied, and therefore the volume of the tube bank used for the superheating, in relation to that used for vaporization.

It has been realized that, by varying the pressure, the temperature, and the flow of the feed water introduced into the secondary casing, it was possible to increase or reduce the superheating while still using a perfectly symmetrical tube bank of far simpler construction than that of a bank divided nonsymmetrically by a partition.

For example, if the pressure and the flow of the feed water are increased, superheating is reduced by delaying the commencement of vaporization and prolonging the existence of a two-phase state of the fluid circulating along the hot branch of the tube bank.

By varying these parameters it is therefore possible to use a longer or shorter length of the hot branch 9 of the tube bank for effecting the superheating.

This has resulted in the effecting of the vaporization over a descending part of the circulation of the fluid in the tube bank, contrarily to the prior art technique.

Figure 4:
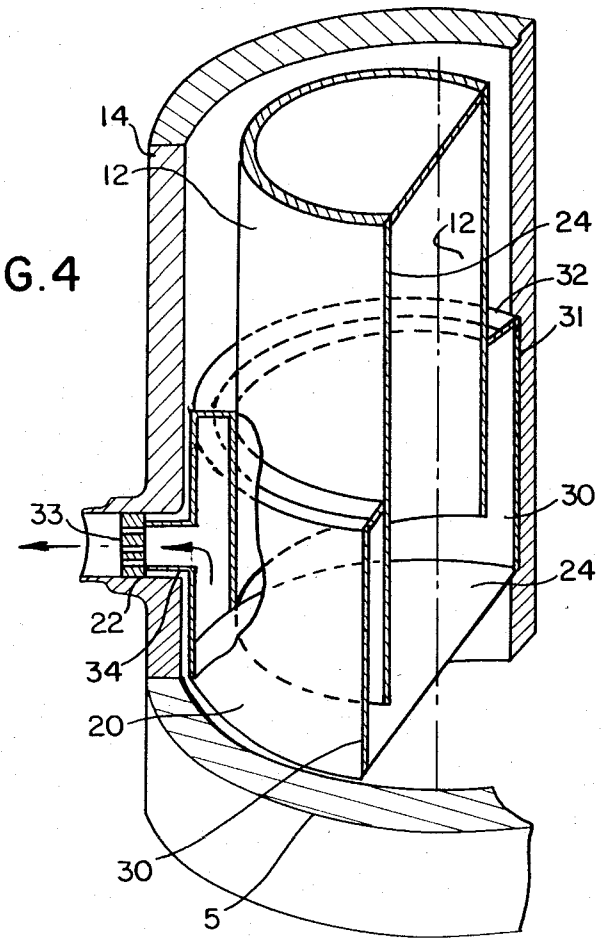
FIG. 4 is a view in perspective of a first embodiment of a steam recuperator equipping a steam generator according to the invention.

FIG. 4 shows a form of construction of the steam recuperator 20 in which the latter forms the bottom part of the tube bank casing 12.

The bottom part of the tube bank casing 12 is restricted so as to form a space 30 above the tube plate 5. The steam recuperator 20 comprises an outer shell 31, which is closed at the top and welded to the casing 12 by means of a rim 32. At the bottom the shell 31 is welded continuously over its entire periphery to the tube plate 5. The dividing partition 24 closes the steam drum of the recuperator in the diametrical plane of the steam generator.

This steam drum is therefore entirely fluid tight and forms the bottom portion of the tube bank casing 12. When the superheated steam reaches the base of the hot branch of the tube bank, this steam can pass through the opening 30 to the interior of the steam drum, from which it is evacuated to the pipe connection 22 via a flexible coupling sleeve 34 between the steam drum and the secondary casing 14.

A flow limiter 33 is in addition interposed on the path of the steam inside the pipe connection 22.

The flexible sleeve 34 makes it possible to take up the differential expansions between the tube bank casing and the secondary casing.

Figure 5:
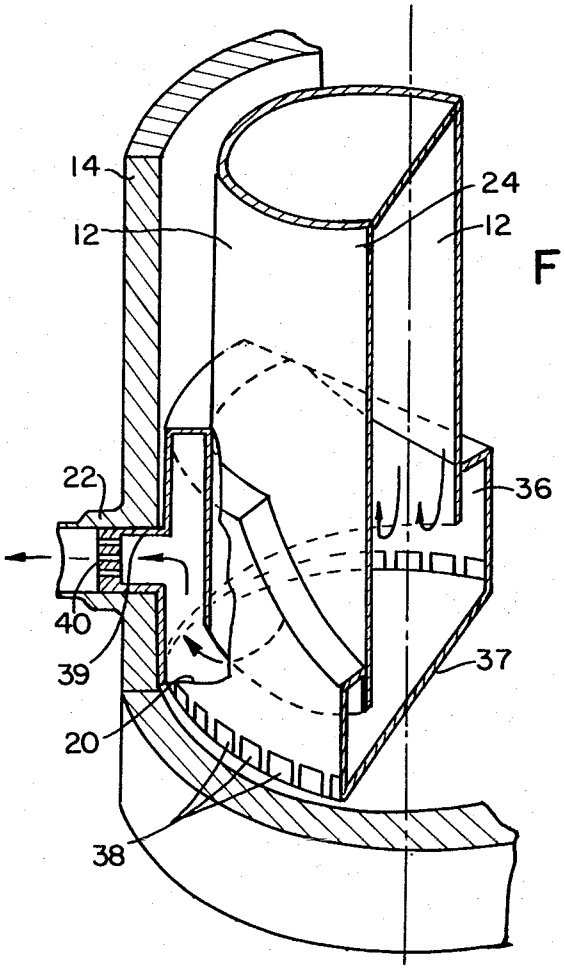
FIG. 5 is a view in perspective of a second embodiment of a steam recuperator associated with a superheated steam generator according to the invention.

In FIG. 5 can be seen a second form of construction of the steam recuperator 20, in which the steam drum is fastened to the bottom of the tube bank casing 12, to which it is welded. This steam drum 36 is in contact with the tube plate 5 by way of a rail type sealing system 37, in the diametrical plane of the generator, and by way of a slat type sealing system 38 at the base of its cylindrical surface. The steam drum 36 is brought into communication with the pipe connection 22 by means of a rigid sleeve 39 constituting a flow limiter 40 inside the pipe connection 22.

The sealing systems 37 and 38 make it possible to absorb play resulting from the mounting and expansion of the apparatus.

This apparatus is obviously not absolutely fluid tight like that shown in FIG. 4.

It can be seen that the principal advantages of the apparatus according to the invention are that it makes it possible in a simple manner to form a reserve of emergency water above the bank of tubes, and therefore enables the operators to intervene with slight delay after a breakdown of the water supply to the steam generator, to introduce the emergency feed water into the space in question, where it is mixed and heated before falling into the annular space as far as the level of the tube plate, and finally to adopt an entirely symmetrical construction for the steam generator, while permitting adjustment of the superheating by acting on the parameters of the feed water introduced into the secondary vessel.

However, the invention is not limited to the embodiment which has been described above; on the contrary, it includes all variants thereof.

Thus, it is possible to provide a vessel of any volume in dependence on the operating conditions of the steam generator. It is sufficient to increase the height of the secondary vessel sufficiently above the tube bank, or to provide an enlarged vessel of frustoconical or cylindroconical shape at the top of the steam generator.

It is also possible to use a steam generator according to the invention which has a reserve capacity, in which the partition of the tube bank is not disposed symmetrically, although this arrangement facilitates and simplifies its construction.

It is also possible to use a steam recuperator of any type at the bottom of the hot branch of the tube bank.

Finally, the steam generator according to the invention can be used not only in the case of pressurized-water nuclear reactors, but also in the case of other high-power installations where the superheating of the steam produced may be required.

We claim:

1. A superheated steam generator comprising (a) a bank of U-tubes (6);

(b) a two-part channel head (1) for supplying said tubes with hot primary fluid and for discharging cooled primary fluid after it has passed through said tube bank and come into thermal contact with feed water to be vaporized;

(c) a secondary casing (14) enclosing said feed water;

(d) a tube plate (5) in which said tubes (6) of said tube bank are fixed and which is fastened to (i) said channel head (1) at its inlet face with which the ends of the tubes are flush, and to (ii) said secondary casing (14) at its outlet face through which said bank of tubes passes; and (e) a casing (12) enclosing said bank of tubes and disposed inside said secondary casing (14) so as to form in conjunction with the latter an annular space (15) into which a primary water inlet connection (21) leads on the outlet or cold branch (10) side of said bank of tubes, said tube bank casing (12) having at least one opening (19) above said tube plate (5) for the passage of said feed water into the interior of said tube bank casing (12) in order to bring said feed water into contact with said cold branch (10);

(f) a separating partition (24) disposed between said cold branch (10) and a hot branch (9) of said tube bank through which the primary fluid passes out, thus enabling said feed water and then steam to be guided along said tube bank;

(g) a superheated steam recuperator (20) disposed in the proximity of the end of said hot branch (9) which passes through said tube plate (5), for the purpose of evacuating the superheated steam through a pipe connection (22) leading into said annular space (15);

(h) a free space (25) being provided inside said secondary casing (14) above said tube bank casing (12) which is completely closed at its upper part, in order to form a reserve of at least 20 tons of feed water for a thermal power of the steam generator of 1000 MW, this power being defined on the basis of the inlet temperature, the outlet temperature and the flow of primary fluid, said free space being in communication with said annular space (15) and with at least one means (26) of supplying water at a temperature lower than the temperature of the primary fluid to keep said free space continuously full of feed water during normal operation of the steam generator.

2. A steam generator as claimed in claim 1, wherein said water reserve (25) has a capacity of about 50 tons for a thermal power of said steam generator of 1000 MW.

3. A steam generator as claimed in claim 1, wherein said cold branch (10) and said hot branch (9) of said tube bank are symmetrical in relation to a plane, and wherein said separating partition (24) is disposed in the plane of symmetry of said tube bank.

* * * * *